US008414398B2

(12) United States Patent
Adiraju et al.

(10) Patent No.: US 8,414,398 B2
(45) Date of Patent: Apr. 9, 2013

(54) WAGERING GAME CONTENT PUBLISHING

(75) Inventors: Srinivyasa M. Adiraju, Vernon Hills, IL (US); Mark B. Gagner, West Chicago, IL (US); Nevin J. Liber, Libertyville, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 11/996,124

(22) PCT Filed: Jul. 12, 2006

(86) PCT No.: PCT/US2006/027162

§ 371 (c)(1),
(2), (4) Date: Jan. 18, 2008

(87) PCT Pub. No.: WO2007/011636

PCT Pub. Date: Jan. 25, 2007

(65) Prior Publication Data

US 2008/0220848 A1 Sep. 11, 2008

Related U.S. Application Data

(60) Provisional application No. 60/700,629, filed on Jul. 19, 2005.

(51) Int. Cl.
*A63F 9/24* (2006.01)

(52) U.S. Cl. ..... 463/42; 463/16; 463/40; 463/43; 709/209; 709/212; 709/216; 709/227

(58) Field of Classification Search ..... 463/16, 463/40, 41, 42, 43; 709/209, 212, 216, 227
See application file for complete search history.

(56) References Cited

U.S. PATENT DOCUMENTS 5,755,621 A * 5/1998 Marks et al. ..... 463/42
5,762,552 A * 6/1998 Vuong et al. ..... 463/25
5,823,879 A * 10/1998 Goldberg et al. ..... 463/42
5,871,398 A * 2/1999 Schneier et al. ..... 463/16

(Continued)

FOREIGN PATENT DOCUMENTS

WO WO-2007133468 A2 11/2007
WO WO-2007133468 A3 11/2007

OTHER PUBLICATIONS

"International Search Report for Application No. PCT/US2006/27162 date mailed Feb. 1, 2007", 4 pgs.
"Written Opinion of the International Searching Authority for Application No. PCT/US2006/27162 date mailed Feb. 1, 2007", 6 pgs.
"U.S. Appl. No. 12/299,692, Non Final Office Action mailed Mar. 24, 2011", 8 pgs.
"International Application Serial No. PCT/US07/10740,Search Report and Written Opinion mailed Aug. 12, 2008", 9 pgs.

*Primary Examiner* — Pierre Eddy Elisca
*Assistant Examiner* — Shahid Kamal
(74) *Attorney, Agent, or Firm* — Schwegman Lundberg & Woessner, P.A.

(57) ABSTRACT

Systems, methods, and machine-readable media including instructions for publishing gaming content are described herein. In one embodiment, a machine-readable medium includes instructions for detecting new gaming content and creating a gaming content publication indicating that the new gaming content is available. The machine-readable medium also includes instructions for transmitting the gaming system publication to a gaming network component.

12 Claims, 14 Drawing Sheets

U.S. PATENT DOCUMENTS

| | | | | |
|---|---|---|---|---|
| 6,024,640 | A * | 2/2000 | Walker et al. | 463/17 |
| 6,607,439 | B2 * | 8/2003 | Schneier et al. | 463/17 |
| 6,811,488 | B2 * | 11/2004 | Paravia et al. | 463/42 |
| 6,863,612 | B2 | 3/2005 | Willis | |
| 7,163,459 | B2 * | 1/2007 | Tanskanen | 463/17 |
| 2002/0057800 | A1 | 5/2002 | Gordon et al. | |
| 2003/0064771 | A1 | 4/2003 | Morrow et al. | |
| 2004/0248646 | A1 | 12/2004 | Canterbury | |
| 2006/0173985 | A1 | 8/2006 | Moore | |
| 2006/0240888 | A1 | 10/2006 | Tanimura | |
| 2006/0264256 | A1 | 11/2006 | Gagner et al. | |
| 2009/0181764 | A1 | 7/2009 | Dasgupta | |
| 2010/0248816 | A1 | 9/2010 | Liber et al. | |
| 2010/0311500 | A1 | 12/2010 | Canterbury et al. | |

* cited by examiner

902

904
906
908
910
912
914

```
<?xml version="1.0" encoding="utf-8" ?>
<feed version="0.3" xmlns="http://purl.org/atom/
    ns#">
    <title>This is a progressive jackpot Feed</title>
    <link rel="alternate" type="text/html"
        href="http://www.wmsgaming.com/" />
    <modified>2004-12-08T14:30:00Z</modified>
    <author>
      <name>Srinivyasa M. Adiraju</name>
    </author>
    <entry>
      <title>Progressive Jackpot</title>
      <link rel="alternate" type="text/html"
          href="http://wmsgaming/progressive/
          jackpot/december/2004" />
      <id>tag:www.wmsgaming.com,2004:12:999
          </id>
      <issued>2004-12-08T14:30:00Z</issued>
      <modified>2004-12-08T14:30:00Z</modified>
    </entry>
</feed>
```

FIG. 9

1000

```
<rss version="0.91">
    <channel>
        <title>Wide Area Progressive Jackpot Feed</title>
        <link>http://www.wmsgaming.com/</link>
        <description>WAP Jackpot Updates.</description>
        <language>en-us</language>
        <copyright>Copyright 1995-2005, WMSGaming.</copyright>
        <managingEditor>nobody@wmsgamgin.com</
            managingEditor>
        <webMaster>webmaster@wmsgaming.com</webMaster>
        <lastBuildDate>/1/2005</lastBuildDate>
        <docs>http://jackpots.wmsgaming.com/rss091</docs>
        <image>
            <title>The WAP Jackpot</title>
            <url>http://www.wmsgaming.com/images/
                WAP_Jackpot.gif</url>
            <link>http://www.wmsgaming.com</link>
            <width>88</width>
            <height>31</height>
            <description>A WAP Jackpot Image.</description>
        </image>
        <item>
            <title>A WAP Jackpot Update</title>
            <link>http://www.wmsgaming.com/WAP/Jackpot/
                Monopoly/January_1st/2004.html</link>
            <description> WAP Jackpot contribution for January 1st is
                $500.00.  </description>
        </item>
    </channel>
</rss>
```

1004 1006 1008 1010 1016 1014

FIG. 10

1100

```
<?xml version="1.0" ?>

<rdf:RDF
 xmlns:rdf="http://www.w3.org/1999/02/22-rdf-syntax-ns#"
 xmlns="http://purl.org/rss/1.0/">


<channel rdf:about="http://www.wmsgaming.com/
      WapJackpotFeed.rdf">
      <title>WMSgaming</title>
      <link>http://www.wmsgaming.com/</link>
      <description> This is a WAP Jackpot Feed.</description>
      <image rdf:resource="http://www.wmsgaming.com/images/
          WAP_jackpot.gif" />
      <items>
        <rdf:Seq>
            <rdf:li resource="http://www.wmsgaming.com/2004/03/
                19.html" />
            <rdf:li resource="http://www.wmsgaming.com/2004/03/
                20.html" />
        </rdf:Seq>
      </items>
 </channel>
 <image rdf:about="http://www.wmsgaming.com/images/
      WAP_Jackpot.gif">
      <title>WMS Gaming</title>
      <link>http://www.wmsgaming.com</link>
      <url>http://wmsgaming.com/images/WAP_Jackpot.gif</url>
</image>
<item rdf:about="http://www.wmsgaming/2004/03/19.html">
      <title>WAP Jackpot information for March 19th</title>
      <link>http://www.wmsgaming.com/2004/03/19.html</link>
      <description>This item describes WAP Jackpots on March 19th.</
          description>
</item>
 <item rdf:about="http://www.wmsgaming.com/2004/03/20.html">
      <title>WAP Jackpot information for  March 20th</title>
      <link>http://www.wmsgaming.com/2004/03/20.html</link>
      <description>This item describes WAP Jackpots on March 19th.
          </description>
</item>
</rdf:RDF>
```

1102

1104

1106

FIG. 11

WAGERING GAME CONTENT PUBLISHING

RELATED APPLICATIONS

This application is a U.S. National Stage Filing under 35 U.S.C. 371 from International Patent Application Serial No. PCT/US2006/027162, filed Jul. 12, 2006, and published on Jan. 25, 2007 as WO 2007/011636 A2 and republished as WO 2007/011636 A3, which claims the priority benefit of U.S. Provisional Application Ser. No. 60/700,629 filed Jul. 19, 2005, the contents of which are incorporated herein by reference.

FIELD

This invention relates generally to the field of wagering game machines and more particularly to the field of publishing content in a wagering game network.

COPYRIGHT

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2006, WMS Gaming, Inc.

BACKGROUND

Description of Related Art

A wide variety of computerized wagering game machines are now available to casino operators and players. Computerized wagering game machines range from slot machines to games that are traditionally played live, such as poker, blackjack, roulette, etc. These computerized games provide many benefits to game owners and gamblers, including increased reliability over mechanical machines, greater game variety, improved sound and animation, and lower overall management cost. Computerized wagering game machines must be designed with many of the same concerns as their mechanical and table game ancestors—they must be fair, they should provide sufficient feedback to make the games fun, and they must meet a variety of gaming regulations to ensure that both the machine owner and player are fairly treated. Further, to ensure success in a competitive gaming market, they should provide gaming experiences that are as attractive as those of older mechanical gaming machines.

Many computerized wagering game machines can work with other wagering game machines and gaming systems, such as by clustering the machines to compete for a single progressive jackpot. The progressive jackpot is typically larger than any single machine jackpot, and the progressive jackpot typically grows as more value is wagered on machines in the progressive jackpot cluster. Computerized wagering game machines can also work with player tracking systems and player messaging systems. For example, a player tracking system can track the player's time on device, amount wagered, and play frequency, while a messaging system can relay messages to the player's machine.

Because wagering game machines typically work with other wagering game machines and other systems (e.g., player tracking and messaging systems), there is a need for communication between the various machines and systems. For example, a casino messaging system may need to communicate information to players who are using particular wagering game machines. Communicating between machines and systems can be difficult, especially in environments where wagering game machines and systems do not conform to a single communication protocol (e.g., because they are from different manufactures). Communications can be further complicated because different gaming machines use different electrical hardware, software, or video displays. Reconfiguring machines and systems to conform to communication protocols and hardware platforms can be extremely time consuming and expensive.

BRIEF DESCRIPTION OF THE FIGURES

The present invention is illustrated by way of example and not limited to the Figures of the accompanying drawings in which:

FIG. 9 is in Extensible Markup Language document formatted according to the Atom 0.3 standard, according to example embodiments of the invention;

FIG. 10 is an Extensible Markup Language document formatted according to the RSS 0.91 standard;

FIG. 11 is an Extensible Markup Language document formatted according to the Resource Description Framework Site Summary 1.0 standard;

OVERVIEW OF SOME EMBODIMENTS

Figure 1:
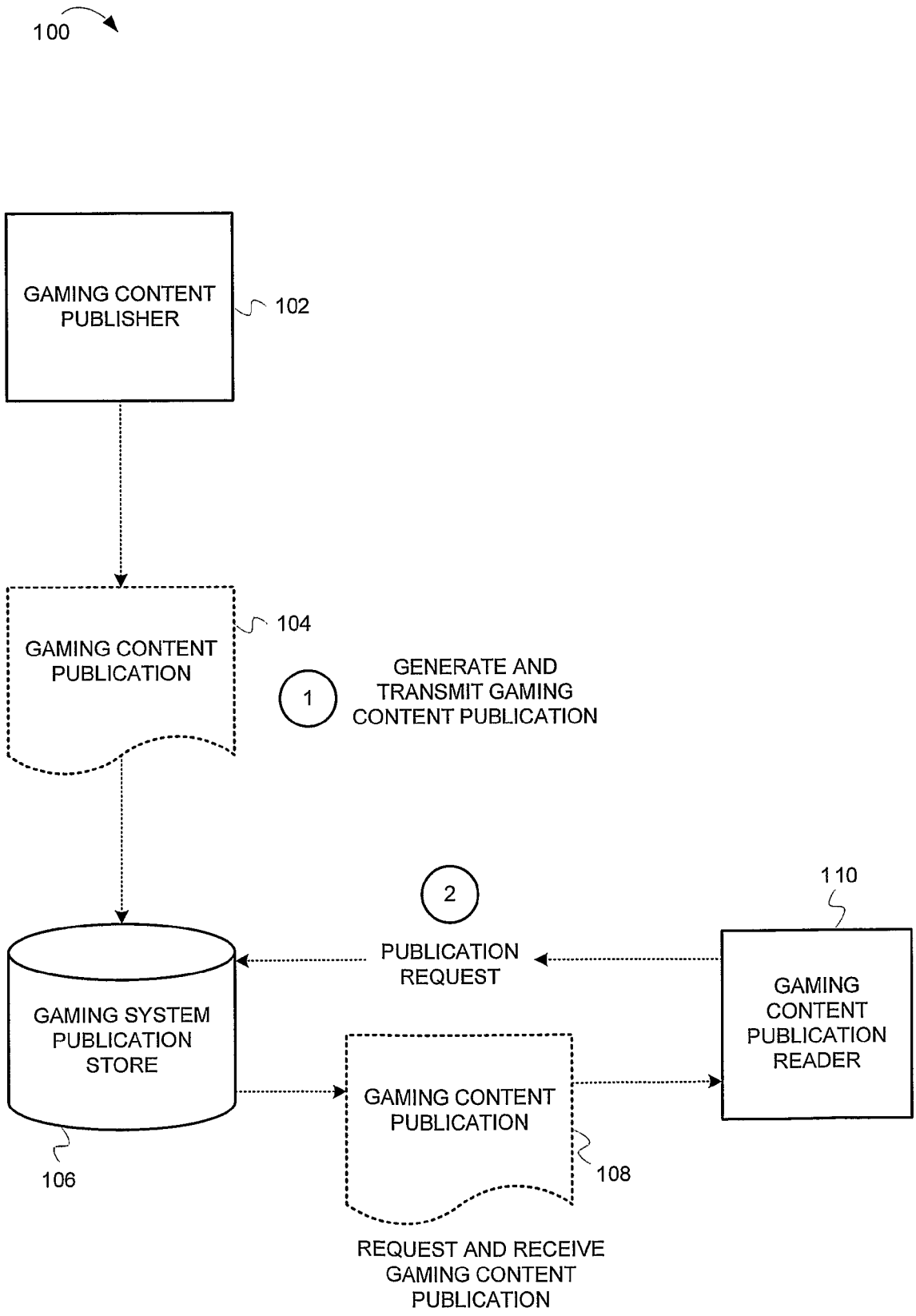
FIG. 1 is a dataflow diagram illustrating dataflow attendant to publishing gaming content in a wagering game network.

Systems, methods, and machine-readable media including instructions for publishing gaming content are described herein. In one embodiment, a machine-readable medium includes instructions for detecting new gaming content and creating a gaming content publication indicating that the new gaming content is available. The machine-readable medium also includes instructions for transmitting the gaming system publication to a gaming network component.

In one embodiment, the method includes receiving a first gaming content publication including a first set of items, where ones of the first set of items are associated with a first set of gaming content. The method can also include receiving a second gaming content publication including a second set of items, where ones of the second set of items are associated with a second set of gaming content. The method can also include determining that new gaming content is available by determining that at least one of the second set of items is not included in the first set of items. The method can also include processing the second gaming content publication to acquire the new gaming content.

In one embodiment a gaming machine is connected to a gaming network, the gaming machine comprising a gaming content publisher to create Extensible Markup Language (XML) documents formatted according to one of a plurality syndication standards, the gaming content publisher to transmit the XML documents to components of the gaming network, and the XML documents to indicate availability of new gaming content. The gaming machine can also include a gaming content publication reader to read the XML documents and acquire the new gaming content. The gaming machine can also include a gaming content monitor to determine when the gaming machine has gaming content for publication to components of the gaming network and to cause the gaming content publisher to create an XML document based on the gaming content. The gaming content publication reader can also be to extract the new gaming content from ones of the XML documents. In one embodiment, the new gaming content includes game themes, game settings, bonus events, pay tables, program code, audio content, or video content. In one embodiment, the gaming content includes accounting information about the gaming machine. In one embodiment, the new gaming content includes information about value received by the gaming machine.

In one embodiment a machine-readable medium includes instructions which when executed by a machine cause the machine to perform operations comprising detecting new gaming content, creating a gaming content publication indicating the new gaming content is available; and transmitting the gaming system publication to a gaming network component. In one embodiment, the gaming system publication is formatted according to a Resource Description Framework Site Summary standard, Really Simple Syndication standard, or a Rich Site Summary standard. In one embodiment, the new gaming content includes executable game code, game math, game art, game configuration data, game operating system features, game peripheral device drivers, attract mode displays, advertisements, or episodic game content.

DESCRIPTION OF THE EMBODIMENTS

Systems and methods for wagering gaming content publishing are described herein. This description of the embodiments is divided into four sections. The first section provides an introduction to embodiments of the invention. The second section describes example gaming networks and gaming machines, while the third section describes example operations for publishing wagering game content. The fourth section provides some example implementation details and the fifth section provides some general comments.

Introduction

This section introduces embodiments of a system for publishing gaming content in a wagering game network.

FIG. 1 is a dataflow diagram illustrating dataflow attendant to publishing gaming content in a wagering game network. In FIG. 1, the system 100 includes a gaming content publisher 102, gaming system content publication store 106, and a gaming content publication reader 110. FIG. 1 shows two stages of dataflow for publishing gaming content in the gaming network 100.

At stage one, the gaming content publisher 102 generates a gaming content publication 104 and transmits it to a gaming content publication store 106. The gaming content publisher 102 can reside within any component of a gaming network (e.g., a gaming content server), while the gaming content publication 104 can be an XML document in RSS format. The gaming content publication 104 can include gaming content or it can include a list of available gaming content. For example, the publication 104 could include new text content for use in a theme-specific wagering game or it could include a list of newly available audio, video, language-specific, and configuration files for a theme-specific wagering game.

At stage two, the gaming content publication reader 110 requests a gaming content publication from the gaming content publication store 106. In response to the request, the publication reader 110 receives the gaming content publication 108. The gaming content publication reader 110 can reside within a gaming machine or other network device. After the gaming content publication reader receives the gaming content publication 108, it can perform additional operations. For example, if the gaming content publication 108 includes a list of available gaming content, the gaming content publication reader 110 can fetch the gaming content from a gaming content server or other network components. Additionally, the gaming content publication reader 110 can install gaming content on the gaming machine in which it resides.

While this section has provided an introduction to embodiments of the invention, the next section describes an example gaming network and gaming machines with which embodiments of the invention can be practiced.

Example Gaming Network and Gaming Machines

This section provides an example gaming network in which embodiments of the invention can be practiced. This section also describes example gaming machines. Operations of gaming network components will be described in the next section.

Example Gaming Network

Figure 2:
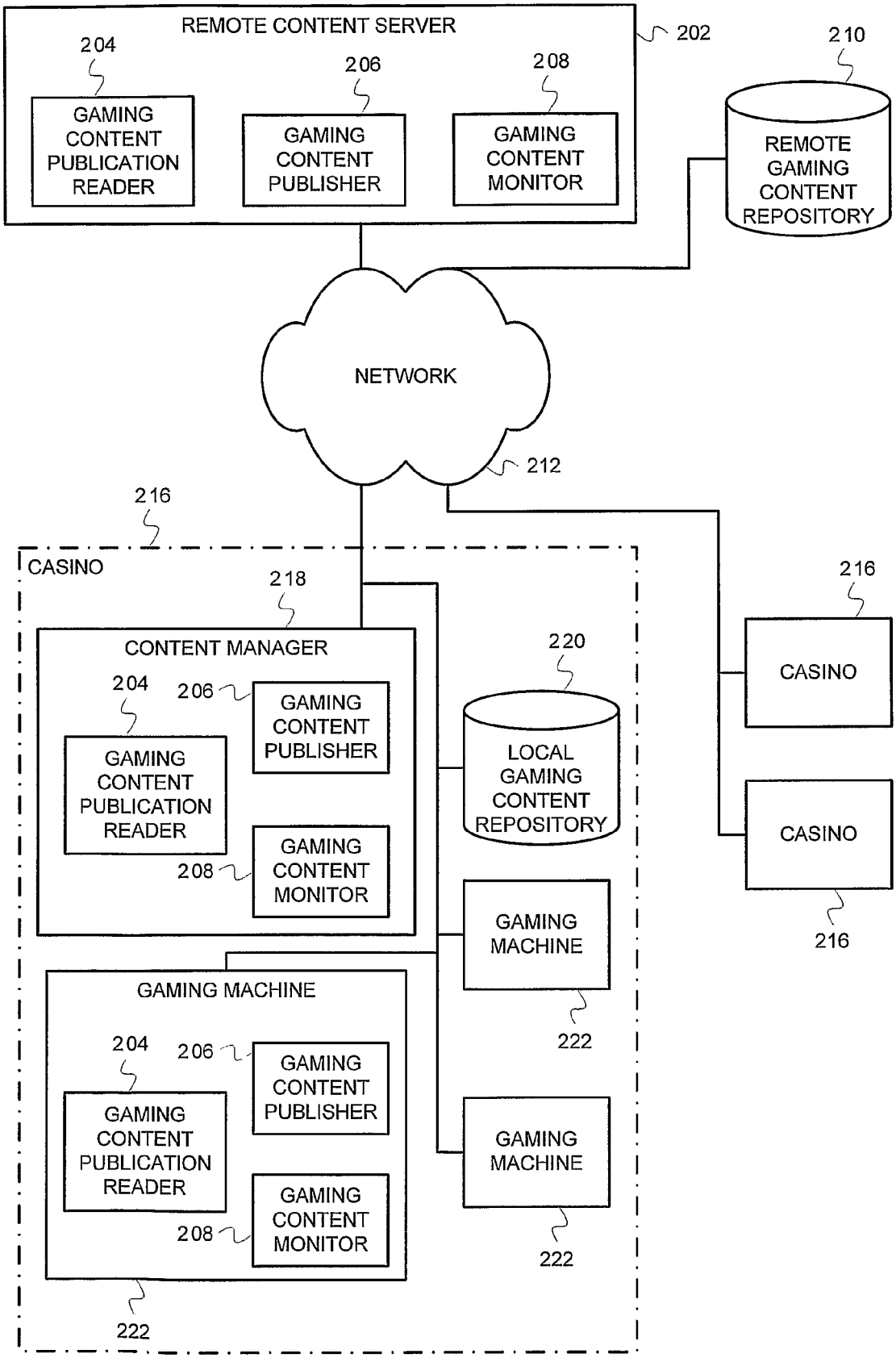
FIG. 2 is a block diagram illustrating a gaming network in which gaming content can be published to network components, according to example embodiments of the invention.

FIG. 2 is a block diagram illustrating a gaming network in which gaming content can be published to network components, according to example embodiments of the invention. As shown in FIG. 2, the gaming network 200 includes a communications network 212, which is connected to a remote gaming content repository 210, remote content server 202, and a plurality of casinos 216. The remote content server 202 includes a gaming content monitor 208, gaming content publisher 206, and gaming content publication reader 204.

As shown in FIG. 2, each of the casinos 216 includes a plurality of gaming machines 222, a content manager 218, and a local gaming content repository 220. Each of the gaming machines 222 can include a gaming content publication reader 204, gaming content publisher 206, and a gaming content monitor 208. Although FIG. 2 shows only the gaming machines 222 and the remote content server 202 including the gaming content publication reader 204, gaming content publisher 206, and gaming content monitor 208, other network devices can include these components. In one embodiment, the remote content server's gaming content monitor 208 monitors the remote gaming content repository 210 for newly added gaming content, while the gaming content publisher 206 publishes the new gaming content (or a list of the new gaming content) to other network components (e.g., gaming machines 222).

In one embodiment, the gaming content publication reader 224 reads and processes gaming content publications received from other gaming network components. In some embodiments, the gaming content publisher 206 and gaming content publication reader 204 use RSS for publishing availability of gaming content. RSS is a family of Extensible Markup Language (XML) file formats for publishing content over networks. The acronym RSS stands for a set of standards including 1) Resource Description Framework Site Summary, 2) Really Simple Syndication, and 3) Rich Site Summary. RSS will be described in greater detail below.

The remote gaming content repository 200 and a local gaming repository 220 can store gaming content for distribution to components of the gaming network 200. The gaming content can include instructions and/or data for conducting wagering games (e.g., video slots, video poker, video black jack, and the like). The gaming content can also include program code, audio content, video content, language content, and/or other data used for conducting all or part of a casino style slots game and/or bonus games. The gaming content can also include executable game code, operating system code, interpretable scripts, byte codes, assembly instructions, game math, art, configuration data (enumerating allowable percentages, denominations, paylines, etc.), operating system features, peripheral device drivers, attract mode displays, advertisements, and episodic game content.

Operations of these and other embodiments are described in greater detail below, in the next section. This description continues with a discussion of example gaming machines.

Example Gaming Machine Architecture

Figure 3:
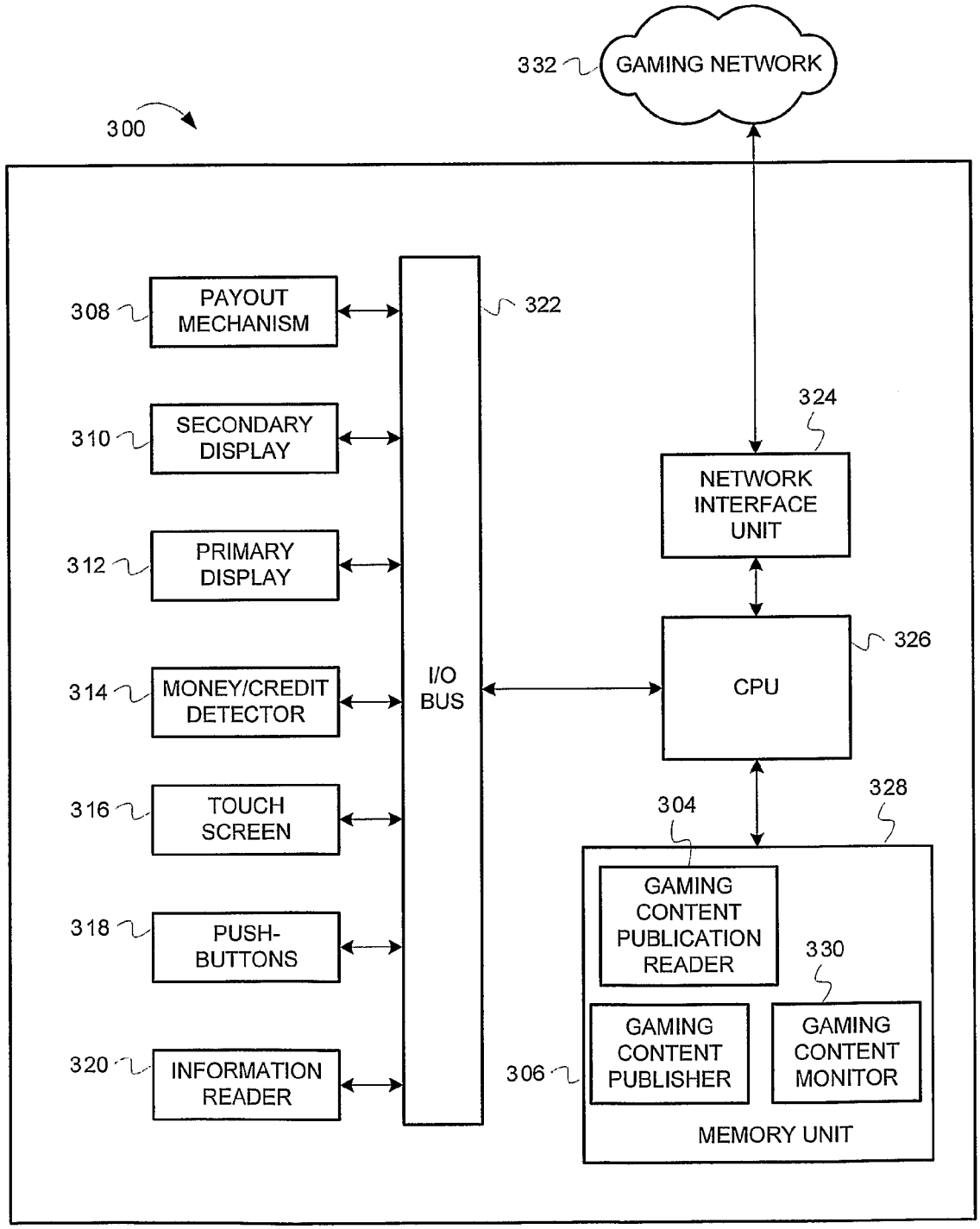
FIG. 3 is a block diagram illustrating components of a gaming machine, used in conjunction with example embodiments of the invention.

FIG. 3 is a block diagram illustrating components of a gaming machine, used in conjunction with example embodiments of the invention. As shown in FIG. 3, the gaming machine 300 includes a central processing unit (CPU) 326 connected to a memory unit 328, which includes a gaming content publisher 306, gaming content publication reader 304 and gaming content monitor 330. The CPU 326 is also connected to a network interface unit 324, which is connected to a gaming network 332. The CPU 326 is also connected to an input/output (I/O) bus 322. The I/O bus 322 is connected to a payout mechanism 308, secondary display 310, primary display 312, money/credit detector 314, touchscreen 316, pushbuttons 318, and information reader 320. The I/O bus 322 facilitates communication between the system components and the CPU 326.

According to some embodiments, the gaming machine 300 can include additional peripheral devices and/or more than one of each component shown in FIG. 3. For example, in one embodiment, the gaming machine 300 can include multiple network interface units 324 and multiple CPUs 326. Additionally, the components of the gaming machine 300 can be interconnected according to any suitable interconnection architecture (e.g., directly connected, hypercube, etc.).

According to some embodiments, the gaming machine 300 includes tangible machine-readable media including instructions for conducting a basic wagering game, conducting a bonus game, and publishing gaming content in a network. Machine-readable media includes any mechanism that provides (i.e., stores and/or transmits) information in a form readable by a machine (e.g., a computer). For example, a tangible machine-readable medium includes read only memory (ROM), random access memory (RAM), magnetic disk storage media, optical storage media, flash memory devices, etc. According to embodiments of the invention, the gaming machine 300 and components of the gaming content servers can include other types of logic (e.g., digital logic) for executing the operations described herein.

According to embodiments, the gaming machine 300 can conduct any suitable casino-style wagering game, such as video poker, video black jack, video slots, video lottery, etc. Additional details about gaming machines used in conjunction with embodiments of the invention are described below, in the discussion of FIG. 4.

Figure 4:
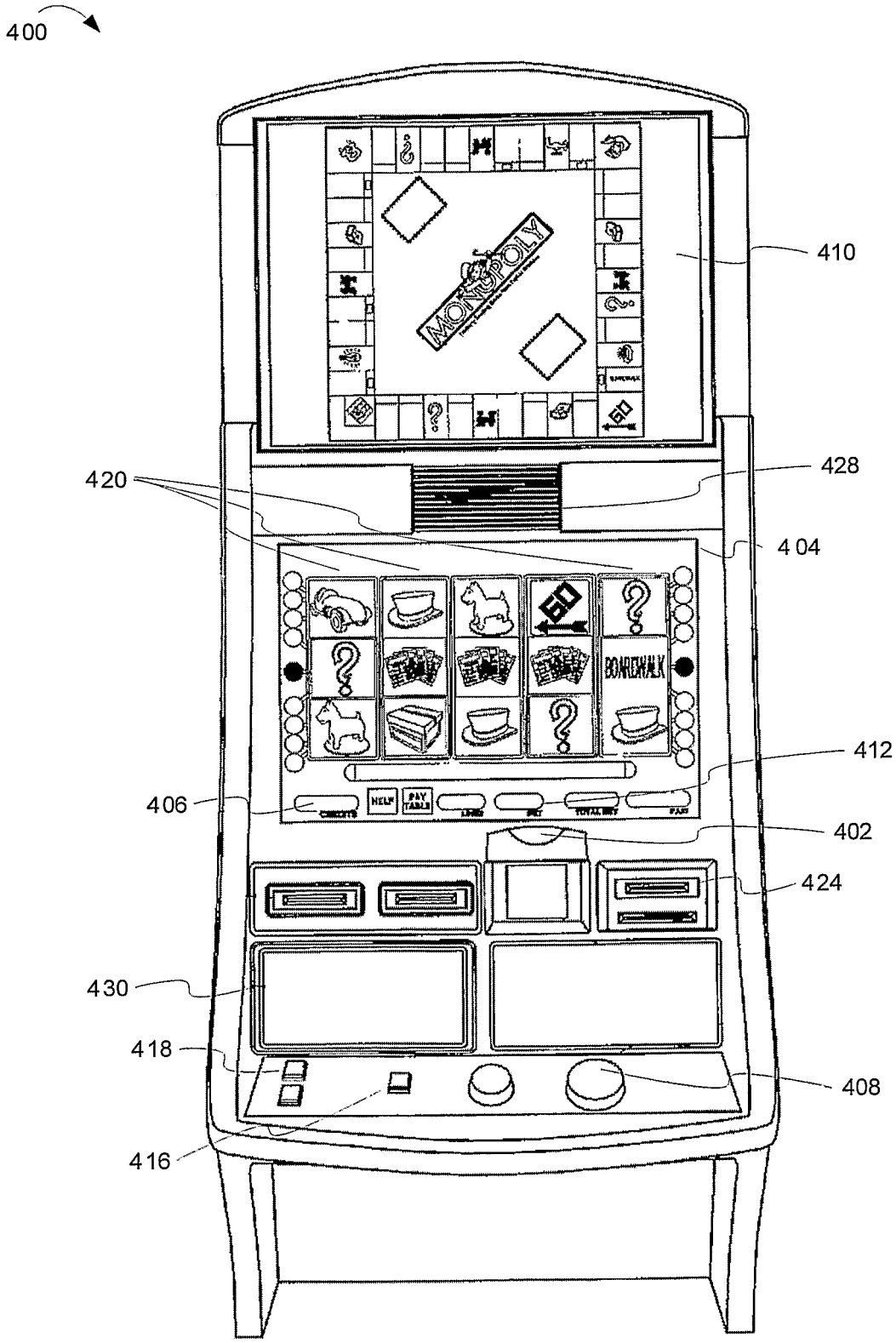
FIG. 4 is a perspective view of a gaming machine, according to example embodiments of the invention.

FIG. 4 is a perspective view of a gaming machine, according to example embodiments of the invention. As shown in FIG. 4, the gaming machine 400 can be a computerized slot machine having the controls, displays, and features of a conventional slot machine.

The gaming machine 400 can be operated while players are standing or seated. Additionally, the gaming machine 400 is preferably mounted on a stand (not shown). However, it should be appreciated that the gaming machine 400 can be constructed as a pub-style tabletop game (not shown), which a player can operate while sitting. Furthermore, the gaming machine 400 can be constructed with varying cabinet and display designs. The gaming machine 400 can incorporate any primary game such as slots, poker, or keno, and additional bonus round games. The symbols and indicia used on and in the gaming machine 400 can take mechanical, electrical, or video form.

As illustrated in FIG. 4, the gaming machine 400 includes a coin slot 402 and bill acceptor 424. Players can place coins in the coin slot 402 and paper money or ticket vouchers in the bill acceptor 424. Other devices can be used for accepting payment. For example, credit/debit card readers/validators can be used for accepting payment. Additionally, the gaming machine 400 can perform electronic funds transfers and financial transfers to procure monies from financial accounts. When a player inserts money in the gaming machine 400, a number of credits corresponding to the amount deposited are shown in a credit display 406. After depositing the appropriate amount of money, a player can begin playing the game by pushing play button 408. The play button 408 can be any play activator used for starting a wagering game or sequence of events in the gaming machine 400.

As shown in FIG. 4, the gaming machine 400 also includes a bet display 412 and a "bet one" button 416. The player places a bet by pushing the bet one button 416. The player can increase the bet by one credit each time the player pushes the bet one button 416. When the player pushes the bet one button 416, the number of credits shown in the credit display 406 decreases by one credit, while the number of credits shown in the bet display 412 increases by one credit.

A player may "cash out" by pressing a cash out button 418. When a player cashes out, the gaming machine 400 dispenses a voucher or currency corresponding to the number of remaining credits. The gaming machine 400 may employ other payout mechanisms such as credit slips (which are redeemable by a cashier) or electronically recordable cards (which track player credits), or electronic funds transfer.

The gaming machine also includes a primary display unit 404 and a secondary display unit 410 (also known as a "top box"). The gaming machine may also include an auxiliary video display 430. In one embodiment, the primary display unit 404 displays a plurality of video reels 420. According to embodiments of the invention, the display units 404 and 410 can include any visual representation or exhibition, including moving physical objects (e.g., mechanical reels and wheels), dynamic lighting, and video images. In one embodiment, each reel 420 includes a plurality of symbols such as bells, hearts, fruits, numbers, letters, bars or other images, which correspond to a theme associated with the gaming machine 400. Furthermore, as shown in FIG. 4, the gaming machine 400 includes a audio presentation unit 428. The audio presentation unit 428 can include audio speakers or other suitable sound projection devices.

In one embodiment, a plurality of gaming machines can be connected to a plurality of download managers in a gaming network. In the gaming network, the gaming machines can publish and receive gaming content, as described herein. Additionally, the gaming machines can conduct casino style wagering games based on the gaming content.

System Operations

This section describes operations performed by embodiments of the invention. In the discussion below, the flow diagrams will be described with reference to the block diagrams presented above. In certain embodiments, the operations are performed by instructions residing on machine-readable media (e.g., software), while in other embodiments, the operations are performed by hardware and/or other logic (e.g., digital logic).

In the discussion below, FIGS. 5-7 describe operations for publishing gaming content and FIGS. 8 and 9 describe operations performed in response to receiving gaming content publications. The discussion will proceed with FIG. 5.

Figure 5:
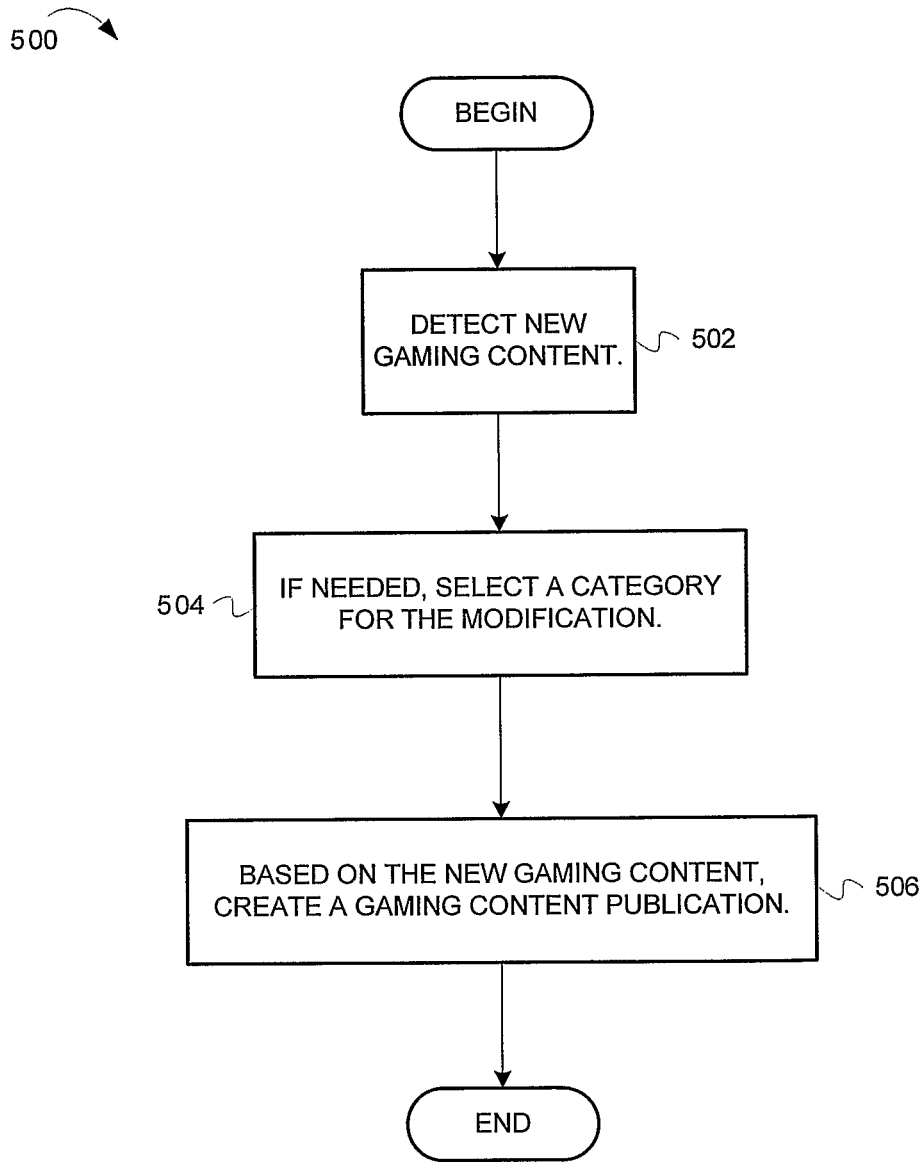
FIG. 5 is a flow diagram illustrating operations for generating a gaming content publication, according to example embodiments of the invention.

FIG. 5 is a flow diagram illustrating operations for generating a gaming content publication, according to example embodiments of the invention. The flow diagram 500 commences at block 502.

At block 502, new gaming content is detected. For example, the remote content server's gaming content monitor 208 detects new gaming content in the remote gaming content repository 210. In one embodiment, the gaming content repository 210 includes a database of gaming content. In one embodiment, the gaming content monitor 208 detects when the gaming content repository 210 commits new gaming content to its database. Alternatively, whenever the remote gaming content repository 210 stores new gaming content in a persistent data store, it transmits a signal to the gaming content monitor 208. New gaming content can include modifications to existing gaming content or altogether new gaming content. The flow continues at block 504.

At block 504, if needed, a category is selected for the new gaming content. For example, if needed, the gaming content monitor 208 categorizes the new gaming content as being relevant to a particular game, set of games, particular hardware, etc. The category may indicate other information about the new gaming content. The flow continues at block 506.

At block 506, a gaming content publication is created based on the gaming content. For example, the gaming content monitor 208 creates a gaming content publication based on the new gaming content. Alternatively, the gaming content monitor 208 inserts an entry associated with the new gaming content into an existing gaming content publication. In one embodiment, gaming content monitor 208 creates an RSS document, whereas in another embodiment, the gaming content monitor 208 inserts an entry into an already-existing RSS document. From block 506, the flow ends.

Figure 6:
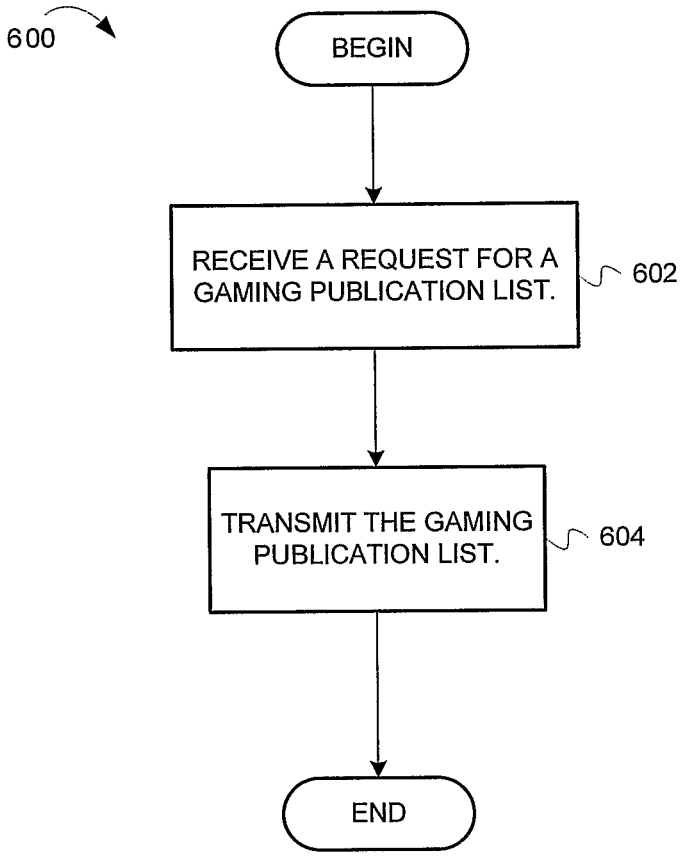
FIG. 6 is a flow diagram illustrating operations for transmitting gaming content publications to network components, according to example embodiments of the invention.

FIG. 6 is a flow diagram illustrating operations for transmitting gaming content publications to network components, according to example embodiments of the invention. The flow diagram 600 commences at block 602.

At block 602, a request for gaming publication is received. For example, the remote content server's gaming content publisher 206 receives a request for a gaming content publication from the content manager's gaming content publication reader 204. The flow continues at block 604.

At block 604, a gaming content publication is transmitted. For example, the remote content server's gaming content publisher 206 transmits a gaming content publication to the content manager's gaming content publication reader 204. In one embodiment, as noted above, the gaming content publication can be an XML document in an RSS format.

In one embodiment, the operations of the flow 600 can be performed by gaming content publishers residing in any network component (e.g., the gaming machines 222, content manager 218, remote content server 202). In other embodiments, the operations can be performed by other suitable components.

Figure 7:
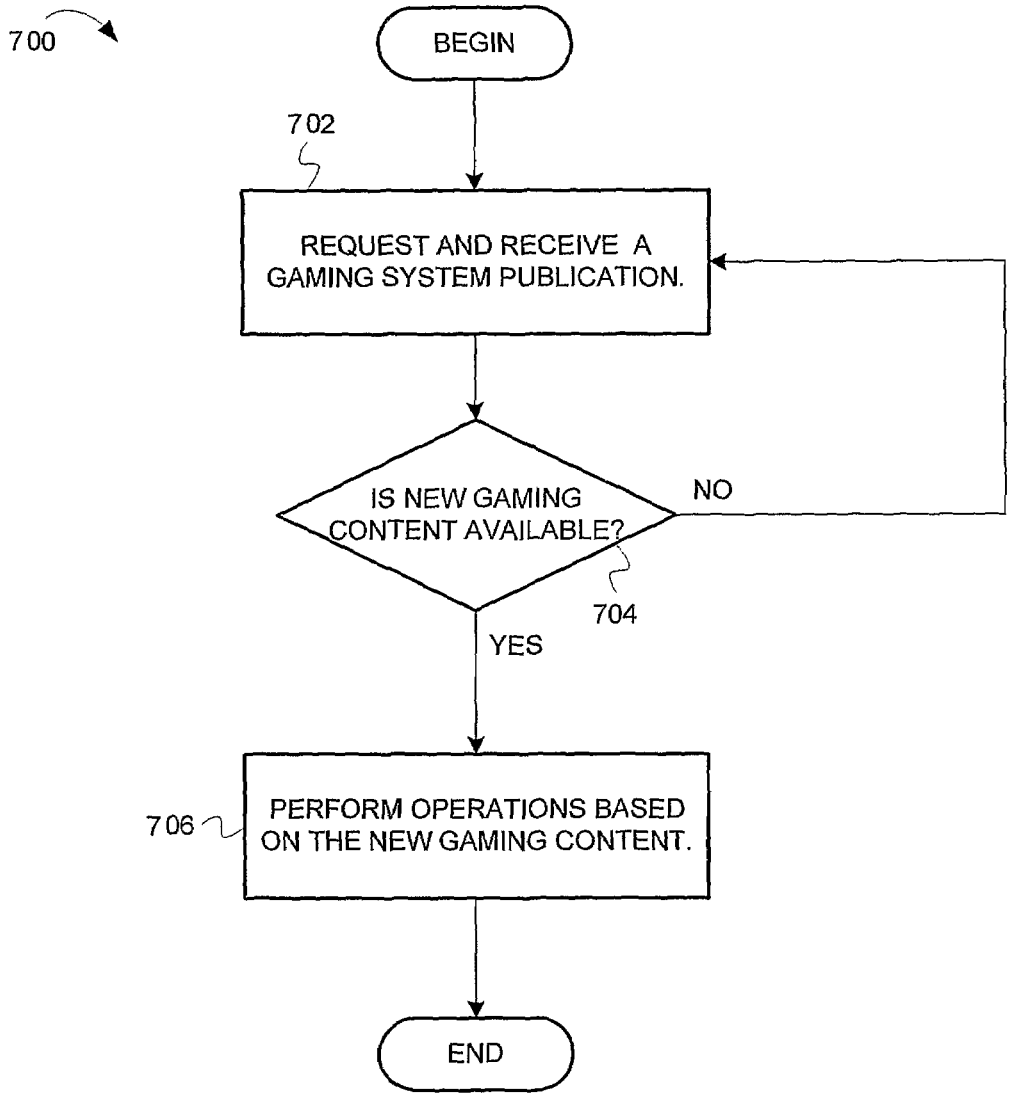
FIG. 7 is a flow diagram illustrating operations for processing gaming content publications, according to example embodiments of the invention.

While FIGS. 5 and 6 describe operations for transmitting and receiving gaming content publications, FIG. 7 describes processing gaming content publications and performing operations based on the contents of the gaming content publications.

FIG. 7 is a flow diagram illustrating operations for processing gaming content publications, according to example embodiments of the invention. The flow diagram 700 commences at block 702.

At block 702, a gaming content publication is requested and received. For example, a gaming machine's gaming content publication reader 204 requests and receives a gaming content publication from the content manager 218. The flow continues at block 704.

At block 704, a determination is made about whether new gaming content is available. For example, the gaming content publication reader 204 compares the gaming content publication with an earlier publication. If the gaming content publication indicates that new gaming content is available, the flow continues at block 706. Otherwise, the flow continues at block 702.

At block 706, operations are performed based on the new gaming content. For example, the gaming machine 222 performs operations based on the new gaming content. In one embodiment, in response to receiving new gaming content, the gaming machine 222 can install the new gaming content (e.g., install gaming software), update gaming information based on the new gaming content, or perform other suitable operations. From block 706, the flow ends. FIG. 8 provides a more detailed example of operations performed when new gaming content is available.

Figure 8:
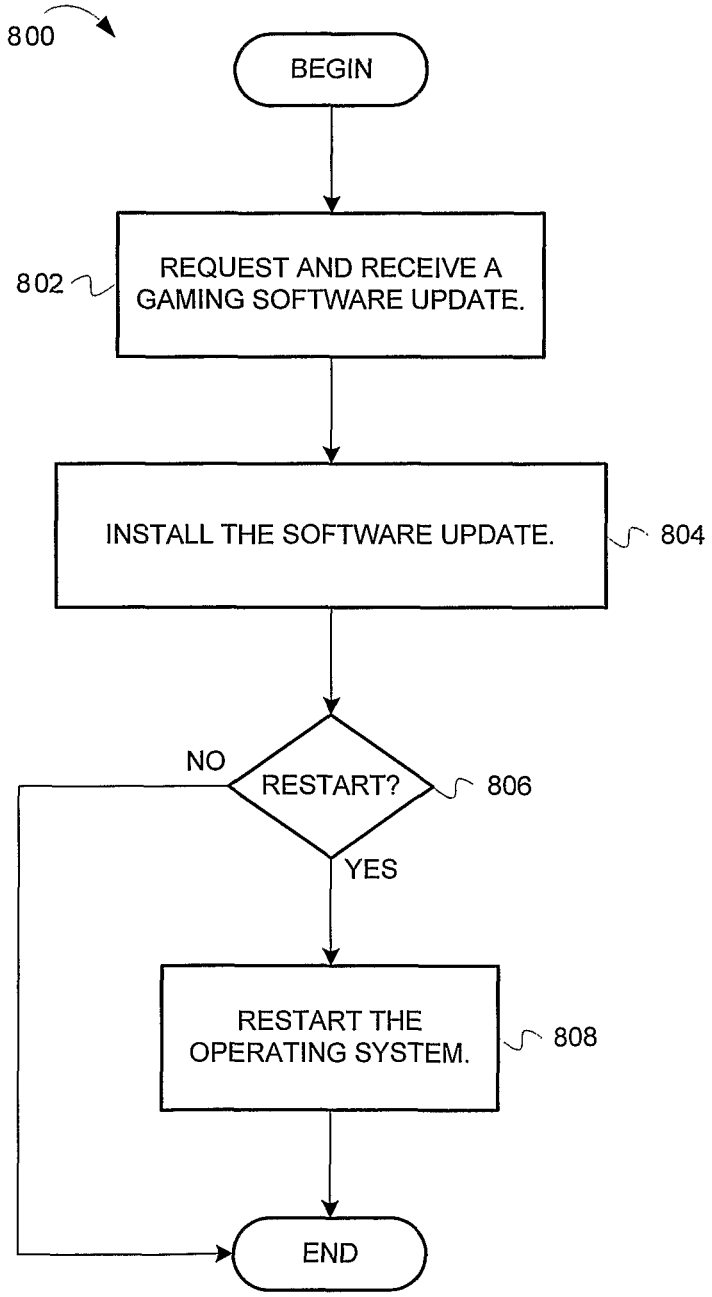
FIG. 8 is a flow diagram illustrating operations performed after determining that new gaming content is available, according to example embodiments of the invention.

FIG. 8 is a flow diagram illustrating operations performed after determining that new gaming content is available, according to example embodiments of the invention. The flow 800 commences at block 802.

At block 802, a gaming software update is requested and received. In one embodiment, before requesting the gaming software update, the gaming machine 222 received a gaming content publication that included a URL for the gaming software update (see discussion of FIG. 7). The gaming machine 222 requests and receives a gaming software update from the local gaming content repository 220. The flow continues at block 804.

At block 804, the software update is installed. For example, the gaming machine 222 integrates the software update into the gaming machine's software and configures it for operation. The flow continues at block 806.

At block 806, a determination is made about whether to restart the system. For example, the gaming machine 222 determines whether it needs to restart its operating system to execute newly installed software update. If there should be a restart, the flow continues at block 808. Otherwise, the flow ends.

At block 808, the system is restarted. For example, the gaming machine 222 restart its operating system to execute the newly installed gaming content. From block 808, the flow ends.

Example Implementation

In this section, example implementation details will be described. While this section describes certain implementation details, embodiments of the invention can be implemented differently. In this section, FIGS. 9-11 describe example gaming content publications, whereas FIGS. 12-14 describe operations for using the publications in gaming network.

FIG. 9 is in Extensible Markup Language document formatted according to the Atom 0.3 standard, according to example embodiments of the invention. According to embodiments, Atom 0.3 documents can be used as gaming content publications. For more information about the Atom standard, see M. Nottingham's and R. Sayre's Network Working Group Internet Draft entitled "The Atom Syndication Format," which is hereby incorporated by reference.

As shown in FIG. 9, the XML document 902 includes a feed element 904. The feed element 904 includes sub elements including a title element 906, link element 908, modified element 910, author element 912, an entry element 914.

In one embodiment, the title element 906 provides a human-readable name for the information feed. In one embodiment, the title element 906 is required, and each feed element can have only one title element 906. In one embodiment, the feed element 904 has at least one link element 908. In one embodiment, the XML document's link elements can include a URL for obtaining gaming content. In one embodiment, the modified element 910 includes a date and time and the author element 910 contains information about the creator of the information feed or information entry. In one embodiment, the feed element 904 can include a plurality of entry elements 914. As shown in FIG. 9, each entry element 914 can include a title element, link element, author element, id element, issued element, and modified element.

FIG. 10 is an Extensible Markup Language document formatted according to the RSS 0.91 standard. According to embodiments, RSS 0.91 documents can be used as gaming content publications. For more information about RSS 0.91, see the RSS 0.91 specification, which is available at http://my.netscape.com/publish/formats/rss-spec-0.91.html and which is hereby incorporated by reference. As shown in FIG. 10, the XML document 1000 includes a channel element 1004, which includes a title element 1006, link element 1008, description element 1010, image element 1016, and an item element 1014.

In one embodiment, the document 1000 can include a plurality of item elements 1014, each of which can include a title sub element, link sub element, and description sub element. In one embodiment, the link sub element includes a URL for procuring available gaming content.

FIG. 11 is an Extensible Markup Language document formatted according to the Resource Description Framework Site Summary 1.0 standard. For more information about RSS 1.0, see the RDF Site Summary 1.0, which is available at http://web.resource.org/rss/1.0/spec and which is hereby incorporated by reference.

As shown in FIG. 11, the RSS 1.0 formatted XML document 1100 includes a channel element 1102, which includes several sub elements. The document 1100 also includes a plurality of image elements 1104 and item elements 1106. The image and item elements include links for retrieving gaming content.

Although FIGS. 1-11 describe specific RSS and Atom formats, any suitable syndication format can be used for sending gaming content publications. In one embodiment, the RSS documents can explicitly include the gaming content. For example, an RSS document's description field can include a text string, which includes gaming content. Alternatively, as described above, the RSS documents can include links to the gaming content.

Figure 12:
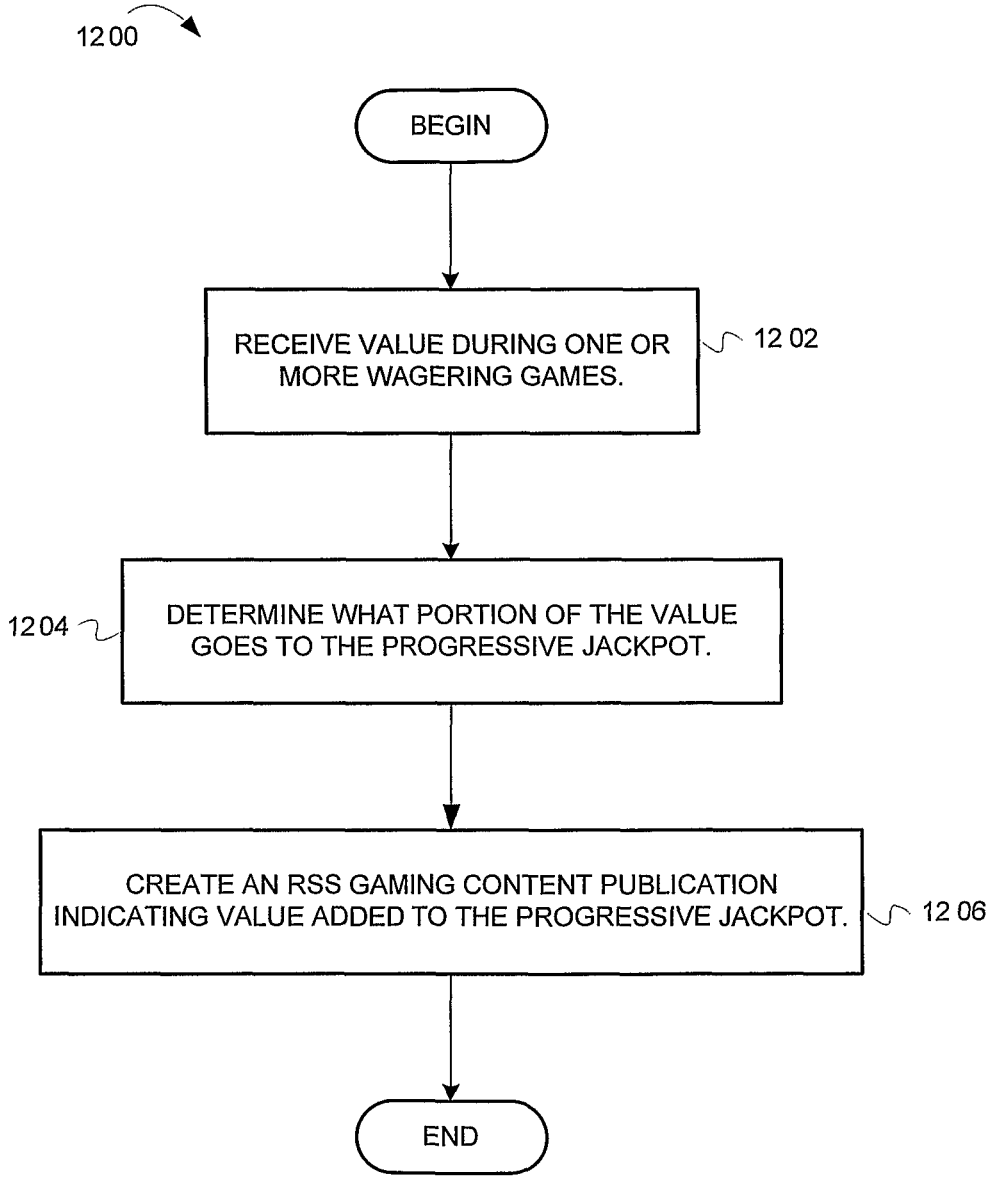
FIG. 12 is a flow diagram illustrating operations for creating RSS gaming content publications in a gaming machine, according to example embodiments of the invention.
Figure 13:
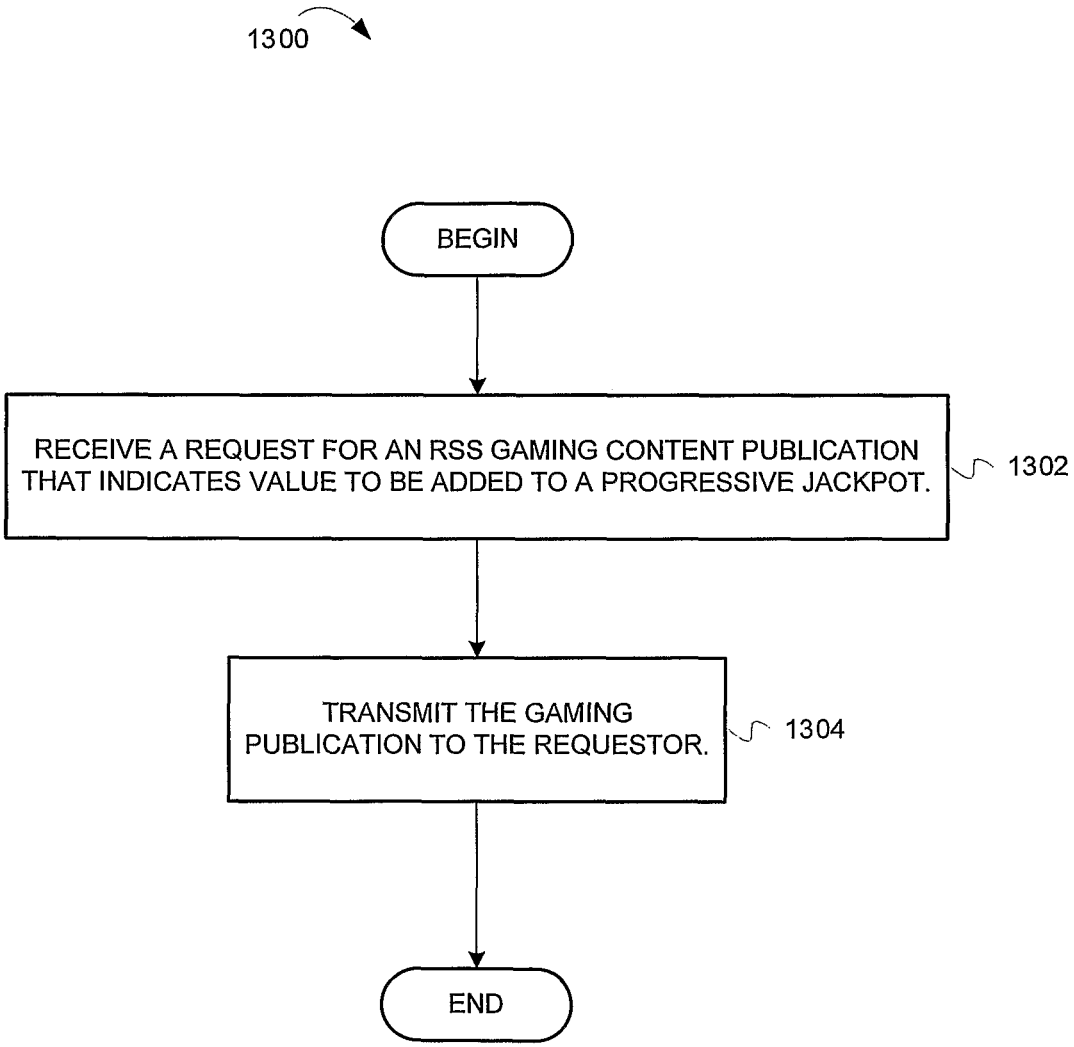
FIG. 13 is a flow diagram illustrating operations for transmitting an RSS gaming content publication, according to example embodiments of the invention.
Figure 14:
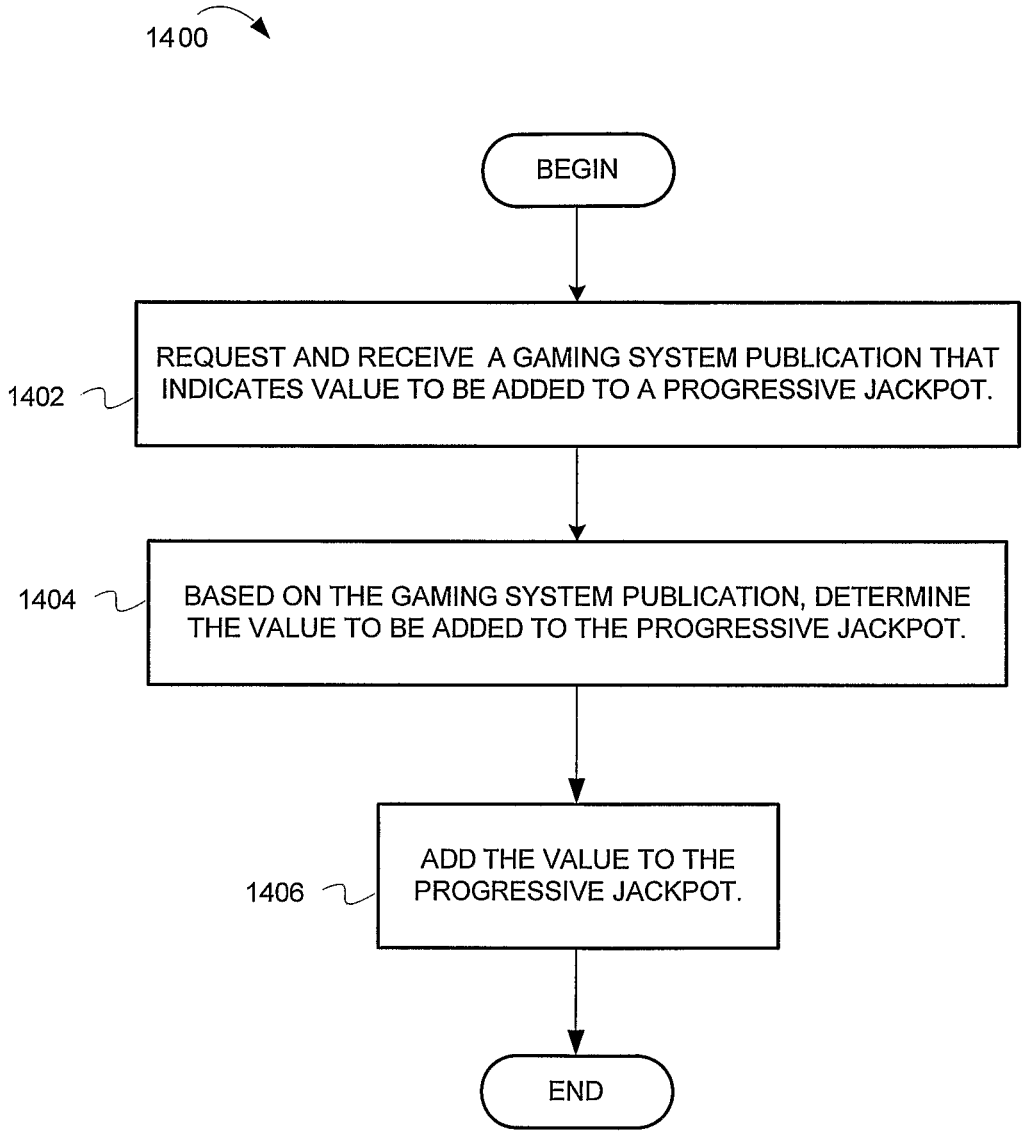
FIG. 14 is a flow diagram illustrating operations for receiving an RSS gaming content publication, according to example embodiments of the invention.

This description will continue with a discussion of FIGS. 12-14, which describe operations for publishing progressive jackpot information using RSS gaming content publications. In particular, FIG. 12 describes creating RSS gaming content publications, while FIGS. 13 and 14 describe publishing the RSS gaming content publications.

FIG. 12 is a flow diagram illustrating operations for creating RSS gaming content publications in a gaming machine, according to example embodiments of the invention. The flow 1200 commences at block 1202.

At block 1202, a gaming machine 222 receives value during one or more wagering games (e.g., slots, blackjack, poker, etc.). The flow continues at block 1204.

At block 1204, the gaming machine determines what portion of the value goes toward a progressive jackpot. In the gaming industry, a "progressive" involves collecting value-in data from participating gaming devices (e.g., slot machines), contributing a percentage of that value-in to a progressive jackpot, and awarding the progressive jackpot to a player upon a certain jackpot-winning event. If the gaming device is a slot machine, a progressive winning event be alignment of certain reel symbols along a certain payline. The progressive jackpot progressively increases as players continue to play without winning the jackpot. Further, as the number of participating gaming machines increases, the jackpot can progressively increase at a much faster rate. The flow continues at block 1206.

At block 1206, the gaming machine 222 creates an RSS gaming content publication, indicating value added to the progressive jackpot. For example, the gaming machine 222 creates an RSS document similar to document 1000, shown in FIG. 10. In one embodiment, the RSS document can include the gaming content. For example, the document's item element 1014 includes a description element, which explicitly indicates a value going toward the progressive jackpot. As shown in FIG. 10, the description sub element of the item element 1014 indicates that $500 is going toward the progressive jackpot. In an alternative embodiment, the contribution toward the progressive jackpot can be determined using the URL in the item's link element. From block 1206, the flow ends.

FIG. 13 is a flow diagram illustrating operations for transmitting an RSS gaming content publication, according to example embodiments of the invention. The flow diagram 1300 commences at block 1302.

At block 1302, a gaming machine's gaming content publisher 206 receives a request for an RSS gaming content publication that indicates value to be added to progressive jackpot. In one embodiment, the gaming content publisher 206 receives the request from the remote content server 202, which administers the progressive jackpot to all participating gaming machines. The flow continues at block 1304.

At block 1304, the gaming machine's gaming content publisher 206 transmits the RSS gaming content publication to the requester (e.g., the remote content server 202). From block 1304, the flow ends.

FIG. 14 is a flow diagram illustrating operations for receiving an RSS gaming content publication, according to example embodiments of the invention. The flow diagram 1400 commences at block 1402.

At block 1402, the remote content server's gaming content publication reader 204 requests and receives an RSS gaming content publication that indicates value to be added to a progressive jackpot. The flow continues at block 1404.

At block 1404, based on the RSS publication, the remote content server 202 determines the value to be added to the progressive jackpot. In one embodiment, the value contribution is explicitly included in the RSS publication. In another embodiment, the value contribution is available at a URL included within the RSS publication. The flow continues at block 1406.

At block 1406, the remote content server 202 adds the value to progressive jackpot. From block 1406, the flow ends.

After determining a new value for the progressive jackpot, the remote content server 202 can publish the progressive jackpot amount to the gaming machines 222 using operations similar to those discussed in FIGS. 12-14.

While the examples in FIGS. 12-14 are described with reference to the RSS document shown in FIG. 10, embodiments of the invention can be performed similar operations using other RSS standards. Moreover, embodiments of the invention are not limited to publishing progressive jackpot information. Instead, embodiments can use RSS documents for publishing any type of gaming content, such as accounting information, fault information, etc.

General

In this description, numerous specific details are set forth. However, it is understood that embodiments of the invention may be practiced without these specific details. In other instances, well-known circuits, structures and techniques have not been shown in detail in order not to obscure the understanding of this description. Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein. Each claim, as may be amended, constitutes an embodiment of the invention, incorporated by reference into the detailed description. Moreover, in this description, the phrase "example embodiment" means that the embodiment being referred to serves as an example or illustration.

Herein, block diagrams illustrate example embodiments of the invention. Also herein, flow diagrams illustrate operations of the example embodiments of the invention. The operations of the flow diagrams are described with reference to the example embodiments shown in the block diagrams. However, it should be understood that the operations of the flow diagrams could be performed by embodiments of the invention other than those discussed with reference to the block diagrams, and embodiments discussed with references to the block diagrams could perform operations different than those discussed with reference to the flow diagrams. Additionally, some embodiments may not perform all the operations shown in a flow diagram. Moreover, although the flow diagrams depict serial operations, certain embodiments could perform certain of those operations in parallel.

The invention claimed is:

1. A wagering gaming machine, comprising:
- a network interface;
- a display;
- a payout mechanism;
- a memory; and
- a processor connected to the payout mechanism and the memory, wherein the processor includes:
  - a gaming content publisher configured to create Extensible Markup Language (XML) documents formatted according to one of a plurality of syndication standards, the gaming content publisher to transmit the XML documents through the network interface to a gaming network and through the gaming network to other gaming components;
  - a gaming content publication reader configured to read XML documents received from the gaming network and to acquire new gaming content, the received XML documents formatted according to the one of the plurality of syndication standards; and
  - a payout controller which pays out via the payout mechanism as a function of the new gaming content;
- wherein the XML documents indicate availability of new gaming content to the components of the gaming network; and
- wherein the gaming content publisher is configured to create an progressive jackpot XML document detailing changes in a progressive jackpot and to transmit the progressive jackpot XML document across the gaming network to gaming components associated with the progressive jackpot.

2. The gaming machine of claim 1, wherein the new gaming content includes game themes, game settings, bonus events, pay tables, program code, audio content, or video content.

3. The gaming machine of claim 1, wherein the new gaming content includes accounting information about the gaming machine.

4. The gaming machine of claim 1, wherein the new gaining content includes executable game code, game math, game art, game configuration data, game operating system features, game peripheral device drivers, attract mode displays, advertisements, or episodic game content.

5. The gaming machine of claim 1, wherein the progressive jackpot XML document is in RSS format.

6. The gaming machine of claim 1, wherein the progressive jackpot XML document includes a URL that can be used to obtain gaming content.

7. A non-transitory machine-readable medium including instructions which, when executed by a wagering gaming machine having a processor, memory, a network interface and a payout mechanism, cause the processor to install:
- a gaming content publisher configured to create Extensible Markup Language (XML) documents formatted according to one of a plurality of syndication standards, the gaming content publisher to transmit the XML documents through the network interface to a gaming network and through the gaming network to other gaming components;
- a gaming content publication reader configured to read XML documents received from the gaming network and to acquire new gaming content, the received XML documents formatted according to the one of the plurality of syndication standards; and a payout controller which pays out via the payout mechanism as a function of the new gaming content;

wherein the XML documents indicate availability of new gaming content to the components of the gaming network; and wherein the gaming content publisher is configured to create an progressive jackpot XML document detailing changes in a progressive jackpot and to transmit the progressive jackpot XML document across the gaming network to gaming components associated with the progressive jackpot.

8. The gaming machine of claim 7, wherein the new gaming content includes game themes, game settings, bonus events, pay tables, program code, audio content, or video content.

9. The gaming machine of claim 7, wherein the new gaming content includes accounting information about the gaming machine.

10. The gaining machine of claim 7, wherein the new gaming content includes executable game code, game math, game art, game configuration data, game operating system features, game peripheral device drivers, attract mode displays, advertisements, or episodic game content.

11. The gaming machine of claim 7, wherein the progressive jackpot XML document is in RSS format.

12. The gaming machine of claim 7, wherein the progressive jackpot XML document includes a URL that can be used to obtain gaining content.

* * * * *

UNITED STATES PATENT AND TRADEMARK OFFICE

CERTIFICATE OF CORRECTION

PATENT NO. : 8,414,398 B2
APPLICATION NO. : 11/996124
DATED : April 9, 2013
INVENTOR(S) : Adiraju et al.

It is certified that error appears in the above-identified patent and that said Letters Patent is hereby corrected as shown below:

In the Specification

In column 2, line 6, delete “manufactures”, insert --manufacturers--, therefor

In column 3, line 29, after “also”, delete “be to”, therefor

In column 3, line 38, delete “cause”, insert --causes--, therefor

In column 5, line 8, delete “224”, insert --204--, therefor

In column 5, line 18, delete “200” and insert --210--, therefor

In column 5, line 22-23, delete “black jack,” and insert --blackjack,--, therefor In column 6, line 11, delete “black jack,” and insert --blackjack,--, therefor In column 6, line 38, delete “transfers”, insert --transfer--, therefor In column 10, line 38, after “be”, insert --an--, therefor In the Claims In column 12, line 45-46, in claim 4, delete “gaining” and insert --gaming--, therefor In column 13, line 22, in claim 10, delete “gaining” and insert --gaming--, therefor In column 13, line 31, in claim 12, delete “gaining” and insert --gaming--, therefor Signed and Sealed this
Seventeenth Day of September, 2013

Teresa Stanek Rea

Teresa Stanek Rea
*Deputy Director of theUnited States Patent and Trademark Office*

UNITED STATES PATENT AND TRADEMARK OFFICE

CERTIFICATE OF CORRECTION

PATENT NO. : 8,414,398 B2
APPLICATION NO. : 11/996124
DATED : April 9, 2013
INVENTOR(S) : Adiraju et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1333 days.

Signed and Sealed this
Twenty-eighth Day of January, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,414,398 B2
APPLICATION NO. : 11/996124
DATED : April 9, 2013
INVENTOR(S) : Adiraju et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1336 days.

Signed and Sealed this
First Day of September, 2015

Michelle K. Lee

Michelle K. Lee
*Director of the United States Patent and Trademark Office*